US010815630B2

(12) United States Patent
Hughes, III

(10) Patent No.: US 10,815,630 B2
(45) **Date of Patent: *Oct. 27, 2020**

(54) PLOW ASSEMBLY AND METHODS OF USING SAME

(71) Applicant: Preston W. Hughes, III, Mobile, AL (US)

(72) Inventor: Preston W. Hughes, III, Mobile, AL (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/137,799

(22) Filed: Sep. 21, 2018

(65) Prior Publication Data

US 2019/0024336 A1 Jan. 24, 2019

Related U.S. Application Data

(63) Continuation of application No. 15/599,608, filed on May 19, 2017, now Pat. No. 10,100,476.

(60) Provisional application No. 62/341,969, filed on May 26, 2016.

(51) Int. Cl.

| | |
|---|---|
| ***E02F 5/18*** | (2006.01) |
| ***E01H 5/06*** | (2006.01) |
| ***E02F 5/10*** | (2006.01) |
| ***E02F 5/14*** | (2006.01) |

(52) U.S. Cl.

CPC ..... *E01H 5/06* (2013.01); *E02F 5/10* (2013.01); *E02F 5/102* (2013.01); *E02F 5/14* (2013.01); *E02F 5/18* (2013.01)

(58) Field of Classification Search

CPC ..... E02F 5/10; E02F 5/102; E02F 5/18
USPC ..... 37/366, 367, 370; 405/138, 180
See application file for complete search history.

(56) References Cited

U.S. PATENT DOCUMENTS

| | | | | |
|---|---|---|---|---|
| 544,850 | A | 8/1895 | Hoefs | |
| 996,866 | A | 7/1911 | Lilly | |
| 1,808,974 | A | 6/1931 | Wilkens | |
| 2,765,724 | A | 10/1956 | Kinsinger | |
| 3,214,920 | A | 11/1965 | Jacobs | |
| 3,371,495 | A | 3/1968 | Kaercher | |
| 3,497,016 | A | 2/1970 | Ryan | |
| 3,563,045 | A | 2/1971 | Hansen | |
| 3,684,030 | A | 8/1972 | Lucero | |
| 3,760,595 | A * | 9/1973 | Stewart | A01B 13/00 405/184 |

(Continued)

OTHER PUBLICATIONS

U.S. Appl. No. 62/341,969, filed May 26, 2016, Preston W. Hughes.

(Continued)

*Primary Examiner* — Gary S Hartmann

(74) *Attorney, Agent, or Firm* — Ballard Spahr LLP

(57) ABSTRACT

A plow assembly for forming a trench within soil of a selected land area. The plow assembly has a blade element, a displacement element, and an attachment element that permits attachment of the plow assembly to a vehicle, such as a tractor. A first end of the displacement element is secured to a distal end of the blade element, and a second end of the displacement element is spaced from a rear edge of the blade element and connected to a pipe. As the plow assembly is advanced within soil, the cutting edge of the blade element cuts through the soil and the displacement element displaces the soil to form the trench and pulls the pipe into the trench as the trench is formed.

19 Claims, 8 Drawing Sheets

(56) References Cited

U.S. PATENT DOCUMENTS

| | | | | |
|---|---|---|---|---|
| 3,777,500 | A | 12/1973 | Kelley | |
| 3,914,948 | A | 10/1975 | Kaercher, Jr. | |
| 4,799,823 | A | 1/1989 | Williams | |
| 4,904,116 | A | 2/1990 | Hesse | |
| 6,186,242 | B1 * | 2/2001 | Bricko | A01B 13/08 172/40 |
| 7,625,154 | B2 | 12/2009 | Hoelting et al. | |
| 10,100,476 | B2 * | 10/2018 | Hughes, III | E01H 5/06 |
| 2002/0066214 | A1 | 6/2002 | Miyazaki | |
| 2009/0311049 | A1 | 12/2009 | Hoelting et al. | |

OTHER PUBLICATIONS

U.S. Appl. No. 15/599,608 (U.S. Pat. No. 10,100,476), filed May 19, 2017 (Oct. 16, 2018), Preston W. Hughes.

* cited by examiner

PLOW ASSEMBLY AND METHODS OF USING SAME

CROSS-REFERENCE TO RELATED APPLICATION

This application is a continuation of U.S. application Ser. No. 15/599,608, filed May 19, 2017, which claims priority to, and the benefit of the filing date of U.S. Provisional Patent Application No. 62/341,969, filed on May 26, 2016. Both of these applications are incorporated by reference herein in their entirety.

FIELD

This invention relates to plow assemblies for forming trenches and pulling and installing pipes within a selected land area and, more particularly, to plow assemblies for forming trenches and pulling and installing pipes without the need for significant restoration of the soil surrounding the trenches.

BACKGROUND

A variety of techniques for installing pipes and other utility lines (conduits, cables, fibers, tapes, and the like) are well-known. Conventionally, a plow apparatus (e.g., a vibratory plow apparatus) is advanced across a selected land area using a tractor or other vehicle, and a cutting edge of the plow creates a trench into which a pipe, utility line or a group of pipes and/or other utility lines can be placed. Typically, the plow causes significant disturbances within the soil surrounding the trench, and workers are required to manually repair (e.g., excavate) the portions of the land area surrounding the trench to retain a desired overall appearance and soil structure for the land area. These repairs must be performed intermittently throughout the installation of the pipe or other utility line, thereby reducing the efficiency of the installation process.

Thus, there is a need for improved plow assemblies and methods for forming trenches for installation of pipes and other utility lines without significantly disturbing the soil surrounding the trenches and/or without the need for substantial manual repair of the soil surrounding the trenches.

SUMMARY

Described herein, in various aspects, is a plow assembly for forming a trench within soil of a selected land area. The plow assembly can have a blade element, a displacement element, and an attachment element. The blade element can have a longitudinal axis and a cutting edge that extends along at least a portion of the blade element relative to the longitudinal axis. The blade element can have opposed proximal and distal ends and a rear edge that is opposed from the cutting edge. The displacement element can have opposed first and second ends. The first end of the displacement element can be secured to the distal end of the blade element. The second end of the displacement element can be spaced from the rear edge of the blade element relative to a transverse axis that is perpendicular to the longitudinal axis of the blade element. The second end of the displacement element can also be configured for coupling to a pipe to be positioned within the trench. The displacement element can have a variable diameter that increases moving from the first end of the displacement element to the second end of the displacement element. The attachment element can be secured to the proximal end of the blade element. The attachment element can be configured to permit selective attachment of the plow assembly to a vehicle. As the plow assembly is advanced within the soil of the selected land area, the cutting edge of the blade element can be configured to cut through the soil of the selected land area, and the displacement element can configured to displace the soil of the selected land area to form the trench and to pull the pipe into the trench as the trench is formed.

Optionally, the plow assembly can further comprise a traction bar secured to the first end of the displacement element. The traction bar can extend outwardly from the first end of the displacement element relative to the transverse axis. The traction bar can be shaped to apply a downward pulling force to the displacement element as the plow assembly is advanced within soil of the selected land area.

In additional aspects, disclosed herein is an apparatus including the plow assembly and a vehicle (e.g., a tractor) having an attachment arm. The attachment element of the plow assembly can be secured to the attachment arm of the vehicle.

Also described herein, in additional aspects, is a method for forming a trench using a plow assembly. The method can include securing a plow assembly to a vehicle (e.g., a tractor). The method can further include securing a pipe to the displacement element of the plow assembly. The method can further include driving the vehicle over a selected land area to advance the plow assembly through soil of the selected land area. As the plow assembly is advanced within the soil of the selected land area, the cutting edge of the blade element cuts through the soil of the selected land area and the displacement element displaces the soil of the selected land area to form a trench while also pulling a pipe into the trench as the trench is formed. When the plow assembly comprises at least one feed tube, the method can further include delivering at least one wire or tape into the trench through the at least one feed tube as the plow assembly is advanced. Optionally, the method does not include restoring the portions of the selected land area surrounding the trench.

Additional advantages of the invention will be set forth in part in the description which follows, and in part will be obvious from the description, or can be learned by practice of the invention. The advantages of the invention will be realized and attained by means of the elements and combinations particularly pointed out in the appended claims. It is to be understood that both the foregoing general description and the following detailed description are exemplary and explanatory only and are not restrictive of the invention, as claimed.

DESCRIPTION OF THE FIGURES

These and other features of the preferred embodiments of the invention will become more apparent in the detailed description in which reference is made to the appended drawings wherein.

DETAILED DESCRIPTION

The present invention can be understood more readily by reference to the following detailed description, examples, drawings, and claims, and their previous and following description. However, before the present devices, systems, and/or methods are disclosed and described, it is to be understood that this invention is not limited to the specific devices, systems, and/or methods disclosed unless otherwise specified, as such can, of course, vary. It is also to be understood that the terminology used herein is for the purpose of describing particular aspects only and is not intended to be limiting.

The following description of the invention is provided as an enabling teaching of the invention in its best, currently known embodiment. To this end, those skilled in the relevant art will recognize and appreciate that many changes can be made to the various aspects of the invention described herein, while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and can even be desirable in certain circumstances and are a part of the present invention. Thus, the following description is provided as illustrative of the principles of the present invention and not in limitation thereof.

As used throughout, the singular forms "a," "an" and "the" comprise plural referents unless the context clearly dictates otherwise. Thus, for example, reference to "a cutting edge" can comprise two or more such cutting edges unless the context indicates otherwise.

Ranges can be expressed herein as from "about" one particular value, and/or to "about" another particular value. When such a range is expressed, another aspect comprises from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the terms "optional" or "optionally" mean that the subsequently described event or circumstance can or cannot occur, and that the description comprises instances where said event or circumstance occurs and instances where it does not.

The word "or" as used herein means any one member of a particular list and also comprises any combination of members of that list.

Figure 1A:
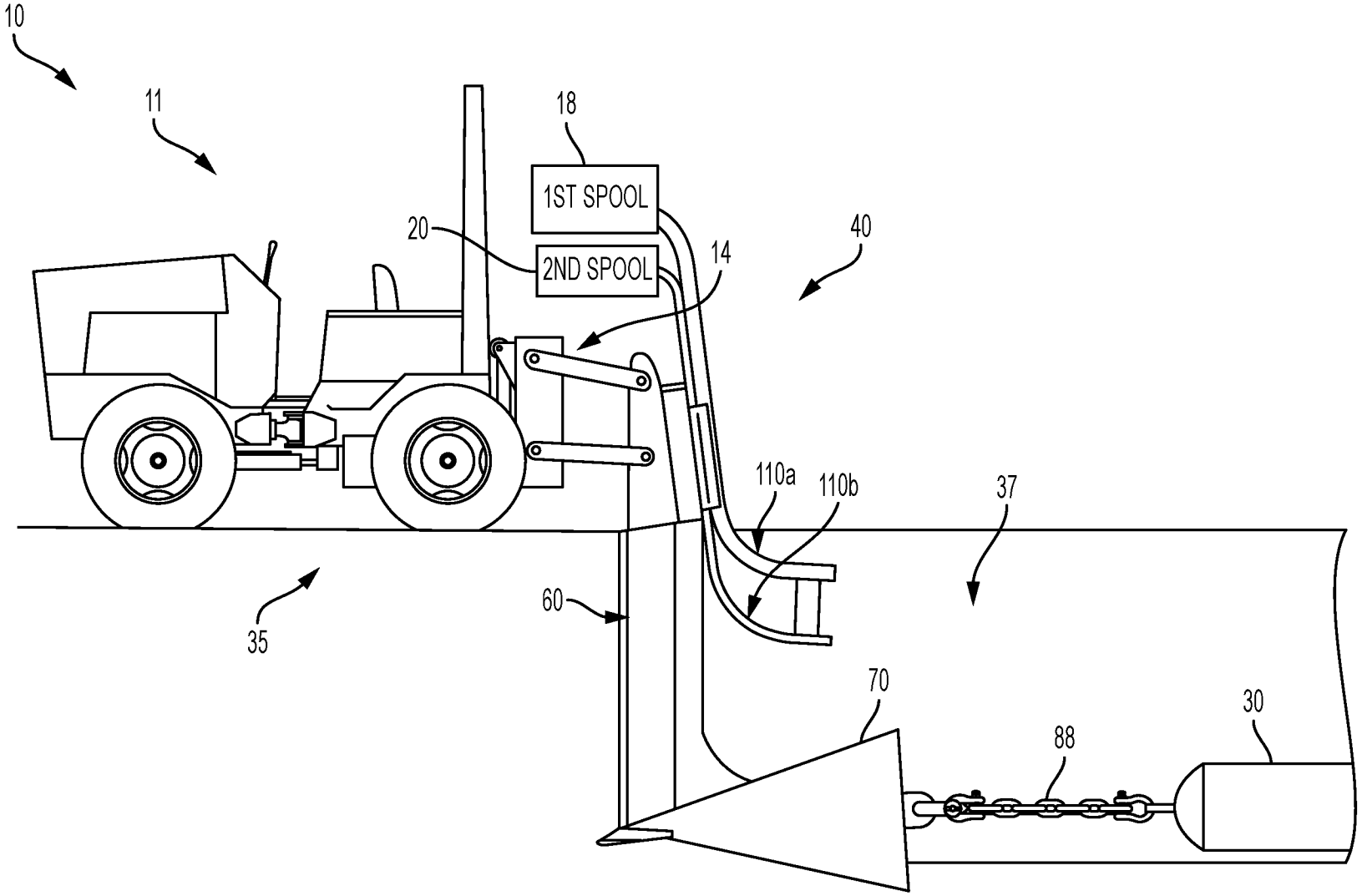
FIG. 1A is a side elevational view of a conventional tractor connected to a plow assembly as disclosed herein.
Figure 1B:
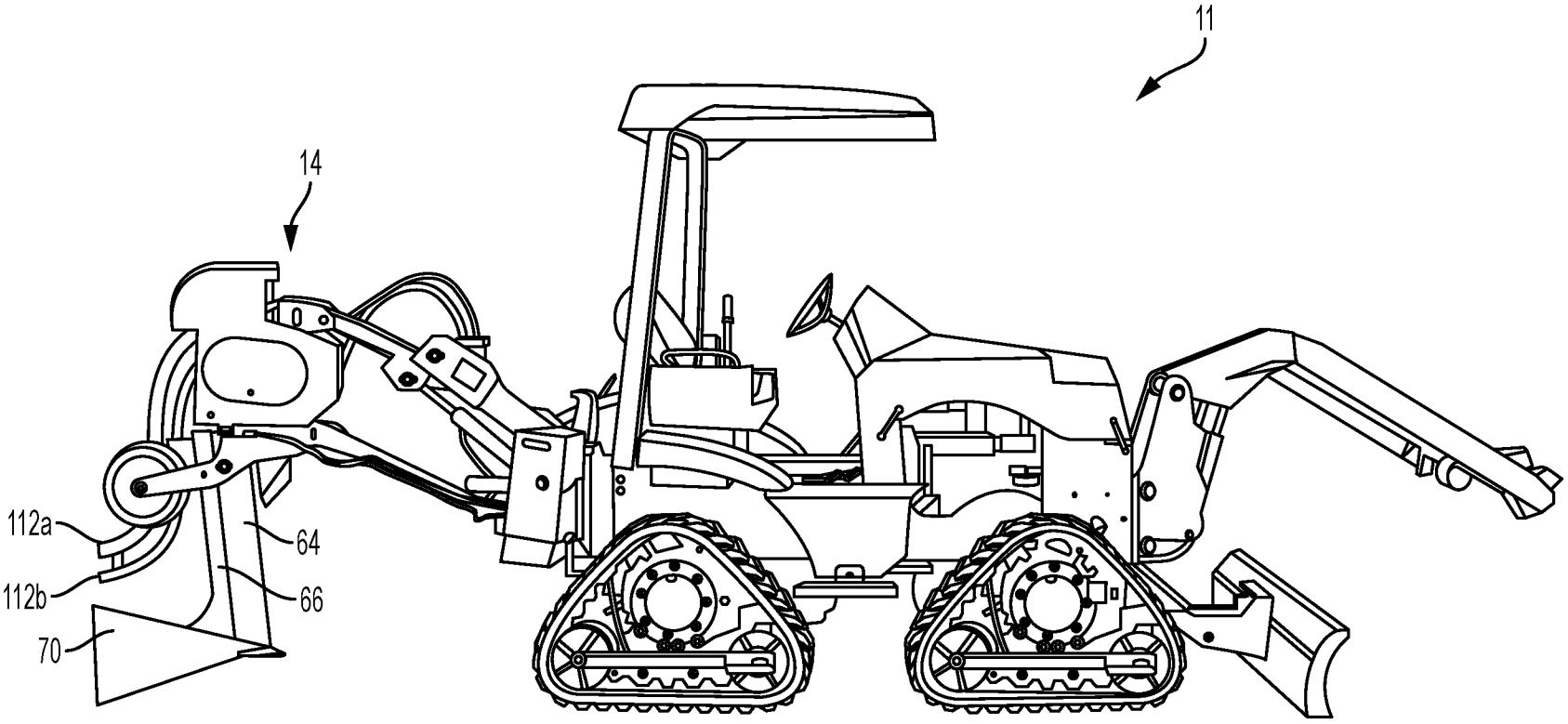
FIG. 1B is an image showing an alternative tractor that can be connected to a plow assembly as disclosed herein.

Described herein with reference to FIGS. 1A-4B is a plow assembly 40 for forming a trench 37 within soil 35 of a selected land area. In exemplary aspects, as further disclosed herein, the plow assembly 40 can be provided as a component of an apparatus 10 for installing a pipe 30 (or other utility line, such as cables, conduits, fibers, and the like) within a trench formed within a selected land area. In exemplary aspects, the pipe 30 can be a water, sewer, or gas pipe. In additional exemplary aspects, as further disclosed herein, the plow assembly 40 can pull the pipe 30 into the trench as the trench is formed. As shown in FIG. 1, the apparatus 10 can comprise a vehicle 11 (e.g., a tractor, such as a plow apparatus), spools of wires or tapes 18, 20 (e.g., tracer wires and "locate"/warning tapes), and a connecting structure 14 (e.g., an attachment arm) for joining the plow assembly 40 to the vehicle 11. All of these components of the apparatus are well known in the art. Two exemplary types of tractors are shown in FIGS. 1A-1B. As shown in FIG. 1A, it is contemplated that the tractor can optionally comprise wheels. Additionally or alternatively, as shown in FIG. 1B, it is contemplated that the tractor can optionally comprise tracks as are known in the art. Although two exemplary tractors are shown in FIGS. 1A-1B, it is contemplated that any conventional tractor or plow apparatus can be used with the plow assembly 40 disclosed herein. In exemplary aspects, the vehicle 11 can comprise a quad plow apparatus, such as those manufactured by VERMEER and DITCH WITCH. Although shown in FIGS. 1A and 4A-4B as having two spools of wires or tape, it is contemplated that the apparatus can comprise any desired number of spools for corresponding wires, tapes, or other elongate lines of material that are conventionally used during a pipe installation process. In exemplary aspects, the pipe 30 can comprise a pipe having a diameter ranging from about three inches to about eight inches. However, it is contemplated that pipes of other sizes can also be installed using the disclosed plow assembly 40. In exemplary aspects, the pipe 30 can comprise 4, 6, or 8 inch pipe as is known in the art. Optionally, in exemplary aspects, the pipe 30 can comprise high-density polyethylene (HDPE) pipe as is known in the art. However, it is contemplated that pipe formed from other conventional materials can be used.

Optionally, the pipe 30 can be provided as uncoiled or unspooled pipe that is extended along a length of the selected land area. Alternatively, the pipe 30 can be provided as coiled or spooled pipe that is gradually pulled from a reel or spool apparatus as is known in the art. Optionally, in one aspect, the reel or spool apparatus can comprise a horizontally oriented carousel-type trailer as is known in the art. Alternatively, in another optional aspect, the reel or spool apparatus can comprise a vertically oriented reel trailer as is known in the art. Optionally, in further exemplary aspects, it is contemplated that the pipe 30 can be provided in coils or reels having an uncoiled length ranging from about 400 to about 2,000 feet per coil/reel. In still further exemplary aspects, it is contemplated that the pipe 30 can be formed from a plurality of such coils that have been fused or otherwise secured together end-to-end.

Figure 2A:
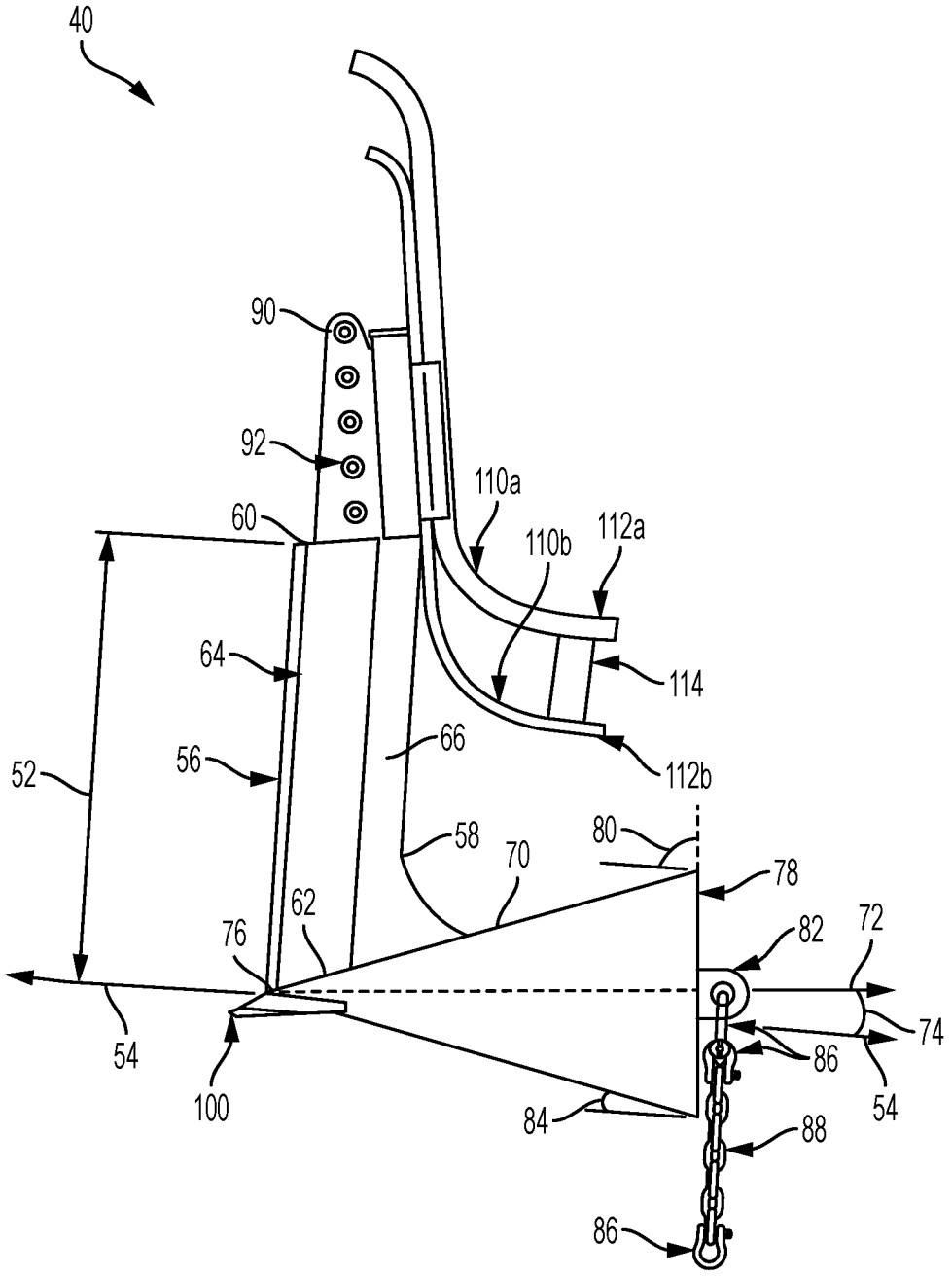
FIG. 2A is a side elevational view of an exemplary plow assembly as disclosed herein.

In exemplary aspects, the plow assembly 40 can comprise a blade element 50, a displacement element 70, and an attachment element 90. In one aspect, as shown in FIGS. 2A-2D, the blade element 50 can have a longitudinal axis 52 and a cutting edge 56 that extends along at least a portion of the blade element relative to the longitudinal axis. In another aspect, the blade element 50 can have opposed proximal and distal ends 60, 62 and a rear edge 58 that is opposed from the cutting edge 56. In a further aspect, the blade element 50 can comprise a wear plate 64 extending from the cutting edge 56 in a rearward direction relative to a transverse axis 54 that is perpendicular to the longitudinal axis of the blade element. Optionally, the wear plate 64 can comprise steel and have a thickness ranging from about 0.10 inches to about 0.50 inches (e.g., about 0.25 inches). In exemplary aspects, as shown in FIG. 2A, the blade element 50 can comprise a plow blank 66 as is known in the art, with the wear plate 64 being positioned between the cutting edge 56 and the plow blank 66 relative to the transverse axis 54. Generally, it is contemplated that the blade element 50 can comprise any conventional plow blade as is known in the art. Thus, it is contemplated that the thickness, longitudinal length, and materials of the blade element 50 can vary according to desired performance characteristics and/or the manufacturer of the blade element.

In further aspects, the displacement element 70 can have opposed first and second ends 76, 78. In these aspects, the first end 76 of the displacement element 70 can be secured to the distal end 78 of the blade element 50. It is further contemplated that the second end 78 of the displacement element 70 can be spaced from the rear edge 58 of the blade element 50 relative to the transverse axis 54. In exemplary aspects, the displacement element 70 can have a variable diameter that increases moving from the first end 76 of the displacement element to the second end 78 of the displacement element. Optionally, it is contemplated that the displacement element 70 can comprise steel, such as, for example and without limitation, stainless steel. In exemplary aspects, the displacement element 70 can comprise steel having a cross-sectional thickness ranging from about 0.10 inches to about 0.50 inches (optionally, about 0.25 inches).

Optionally, in further exemplary aspects, the displacement element 70 can have a consistent inward taper moving from the second end 78 of the displacement element to the first end 76 of the displacement element. For example, in some aspects, the displacement element 70 can have a generally conical shape and have a generally circular or round cross-sectional shape. However, it is contemplated that other cross-sectional shapes, including oval shapes, can be used. Optionally, in one exemplary aspect, the displacement element 70 can be consistently outwardly tapered at a taper angle 84 ranging from about 5 degrees to about 30 degrees. Optionally, in another exemplary aspect, the first end 76 of the displacement element 70 can have a diameter ranging from about 0.10 inches to about 2 inches, and the second end 78 of the displacement element can have a diameter ranging from about 8 inches to about 16 inches. In a further aspect, the first end 76 of the displacement element 70 can have a diameter ranging from about 0.20 inches to about 1 inch, and the second end 78 of the displacement element can have a diameter ranging from about 10 inches to about 14 inches. In still another aspect, the first end 76 of the displacement element 70 can have a diameter of about 0.25 inches, and the second end 78 of the displacement element can have a diameter of about 12 inches. These size ranges are merely exemplary, and it is contemplated that other dimensions can be used, provided they are compatible with the size of any utility line that is delivered to the trench formed by the plow assembly 40 as disclosed herein.

Optionally, it is contemplated that the displacement element 70 can be permanently secured to the blade element 50. In some exemplary aspects, the displacement element 70 and the blade element 50 can be integrally formed. In other exemplary aspects, the displacement element 70 and the blade element 50 can be separately formed and then welded together or otherwise permanently attached. Alternatively, it is contemplated that the displacement element 70 can be selectively detachable from the blade element 50. For example, it is contemplated that the displacement element 70 can be connected to the blade element 50 using a conventional fastener, including a bolt, a threaded connector, a pin, and the like.

Optionally, in exemplary aspects, and with reference to FIG. 2A, the second end 78 of the displacement element 70 can be positioned at an acute angle 80 ranging from about 5 degrees to about 20 degrees relative to the transverse axis 54. Optionally, in further exemplary aspects, and with reference to FIG. 2A, the displacement element 70 can have a central axis 72 that is positioned at an acute angle 74 ranging from about 5 degrees to about 20 degrees relative to the transverse axis 54.

Figure 2B:
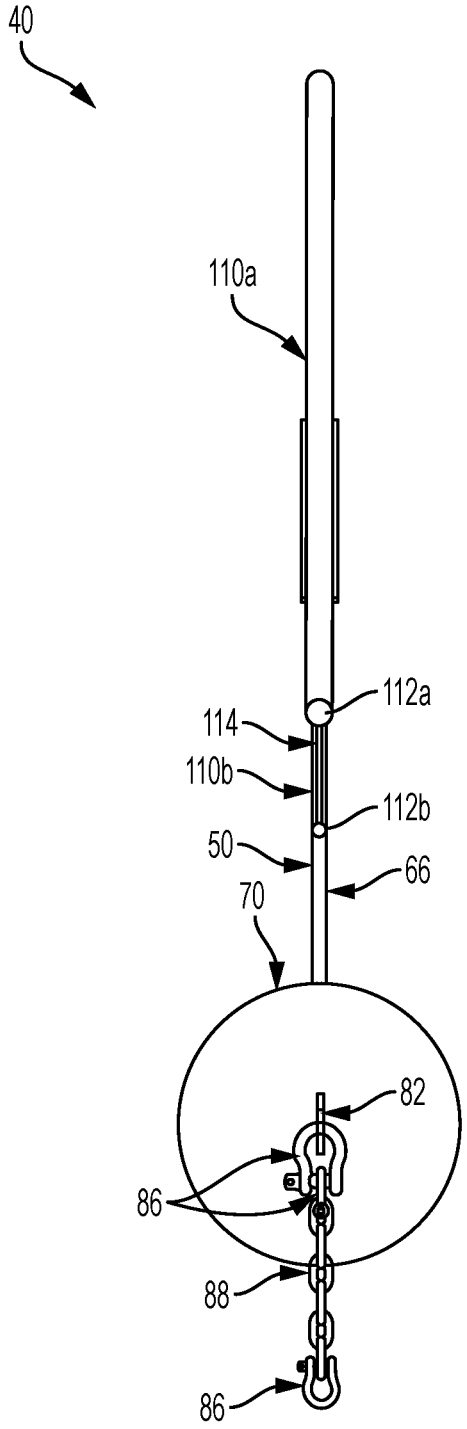
FIG. 2B is a rear elevational view of the plow assembly of FIG. 2A.
Figure 2C:
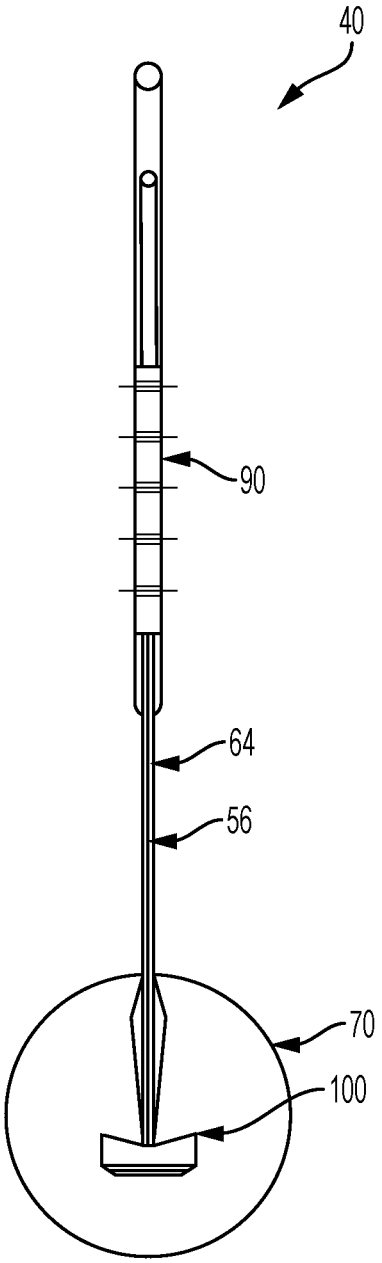
FIG. 2C is a front elevational view of the plow assembly of FIG. 2A.

In exemplary aspects, the second end 78 of the displacement element 70 can comprise (optionally, define) a pulling eye 82 that is configured to receive a portion of a chain 88. In these aspects, it is contemplated that the pulling eye 82 can be used to selectively pull the pipe 30 as the plow assembly 40 is advanced through the soil as disclosed herein. As shown in FIGS. 2A-2C, the chain 88 can optionally comprise shackles 86. In exemplary aspects, the chain 88 can have a length of about 18 inches to about 36 inches (optionally, about 24 inches). Optionally, in these aspects, the chain 88 can be a 70 high test chain having a grade of about 0.5 inches. In further exemplary aspects, the chain 88 and/or shackles 86 can be configured for coupling or attachment to a pipe 30 using conventional means, including, for example and without limitation, a pipe puller apparatus as is known in the art.

As the plow assembly 40 is advanced within the soil 35 of the selected land area, the cutting edge 56 of the blade element 50 can be configured to cut through the soil of the selected land area and the displacement element 70 can be configured to displace the soil of the selected land area to form the trench while also pulling the pipe into the trench as the trench is formed.

In additional aspects, the attachment element 90 can be secured to the proximal end 60 of the blade element 50. In these aspects, the attachment element 90 can be configured to permit selective attachment of the plow assembly 40 to a vehicle 11. In exemplary aspects, the attachment element 90 can define a plurality of axially spaced holes 92 that are configured for alignment with corresponding holes of a connecting structure 14 of a vehicle 11.

Figure 2D:
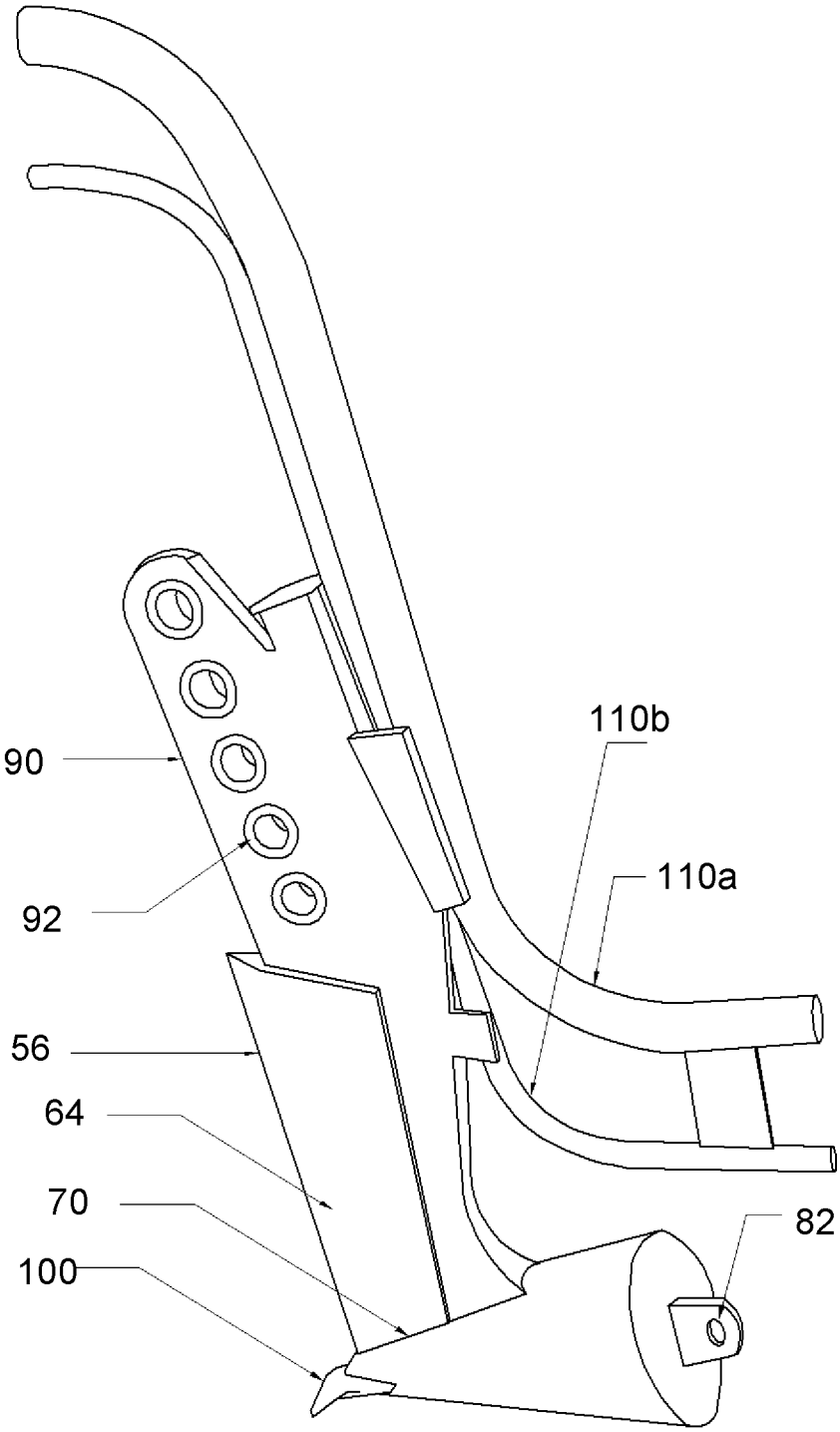
FIG. 2D is a rear perspective view of the plow assembly of FIG. 2A.

Optionally, in exemplary aspects, the plow assembly 40 can further comprise a traction bar 100 secured to the first end 76 of the displacement element 70. In these aspects, the traction bar 100 can extend outwardly from the first end 76 of the displacement element 70 relative to the transverse axis 54. In further aspects, the traction bar 100 can be shaped to apply a downward pulling force to the displacement element 70 as the plow assembly 40 is advanced within soil 35 of the selected land area. As shown in FIGS. 2C-2D, the traction bar 100 can optionally have an upper surface with a concave curvature. In exemplary aspects, the traction bar 100 can have a length (relative to the transverse axis 54) ranging from about 8 inches to about 12 inches (optionally, about 10 inches). In further exemplary aspects, the traction bar 100 can have a width (relative to an axis that is perpendicular to the longitudinal axis 52 and the transverse axis 54) ranging from about 3 inches to about 5 inches (optionally, about 4 inches). In still further exemplary aspects, the traction bar 100 can have a thickness (relative to the longitudinal axis 52) ranging from about 0.5 inches to about 0.75 inches (optionally, about ⅝ inch).

In another aspect, as shown in FIGS. 2A-2D, the plow assembly 40 can further comprise at least one feed tube coupled, secured, or mounted to one or more of the attachment element 90 and the blade element 50. In this aspect, each feed tube of the at least one feed tube can have an outlet positioned rearwardly of the blade element 50 relative to the transverse axis 54. In use, the at least one feed tube can be configured to deliver a tracer wire and/or warning/"locate" tape to the trench formed by the blade element 50 and the displacement element 70. Thus, it is contemplated that the tracer wire and/or warning/"locate" tape can be delivered to a top portion of the trench while the pipe 30 is installed in a lower portion of the trench. Optionally, as shown in FIG. 2D, the attachment element 90 or the blade element 50 (optionally, both the attachment element and the blade element) can define support or guide features that support the at least one feed tube in a desired orientation relative to the attachment element 90, the blade element 50, and a vertical axis, while also restricting undesired movement (e.g., horizontal movement) of the at least one feed tube.

Optionally, in exemplary aspects, the at least one feed tube can comprise a plurality of feed tubes 110*a*, 110*b*. In these aspects, it is contemplated that the plurality of feed tubes 110*a*, 110*b* can have respective outlet ends 112*a*, 112*b* that are vertically spaced. In further exemplary aspects, the plurality of feed tubes can comprise a first feed tube 110*a* having an inner diameter that is different than an inner diameter of at least one other feed tube (e.g., second feed tube 110*b*) of the plurality of feed tubes. Optionally, the outlet ends 112*a*, 112*b* of the feed tubes 110*a*, 110*b* can be coupled together by a bracket 114 or other support element that supports the feed tubes while maintaining a desired vertical spacing between the outlet ends. In some optional aspects, it is contemplated that the feed tubes 110*a*, 110*b* can be aligned within a plane containing a vertical axis. It is further contemplated that the spacing between the feed tubes 110*a*, 110*b* can vary along the lengths of the feed tubes. For example, when outlet ends 112*a*, 112*b* of the feed tubes 110*a*, 110*b* are supported in spaced relation by a bracket 114, it is contemplated that the spacing between the feed tubes can decrease moving toward the inlet ends of the feed tubes (opposed from the outlet ends). As shown in FIGS. 1A-2A and 2D, it is contemplated that each feed tube 110*a*, 110*b* can have a curved profile, such as, for example, a curved profile having an inlet portion oriented in a generally forward direction (with respect to the direction of travel of the vehicle), an outlet portion oriented in a generally rearward direction, and an intermediate portion extending between the inlet and outlet portions, with the intermediate portion being positioned in a generally vertical orientation or being oriented at an acute angle, such as an angle ranging from about 5 degrees to about 45 degrees or from about 10 degrees to about 30 degrees, relative to a vertical axis. In operation, the curved profile of each feed tube 110*a*, 110*b* can be configured to direct tracer wire or warning/"locate" tape to a desired location within a trench as the trench is formed.

In exemplary aspects, the plow assembly 40 can be provided as a component of a pipe installation apparatus 10. In these aspects, the apparatus 10 can comprise a vehicle 11 having a connecting structure 14 (e.g., an attachment arm). It is contemplated that the attachment element 90 of the plow assembly 40 can be secured to the connecting structure 14 (e.g., attachment arm) of the vehicle 11. In exemplary aspects, the vehicle 11 can be a tractor, such as, for example and without limitation, a vibratory plow tractor. However, it is contemplated that any vehicle can be used.

Figure 4A:
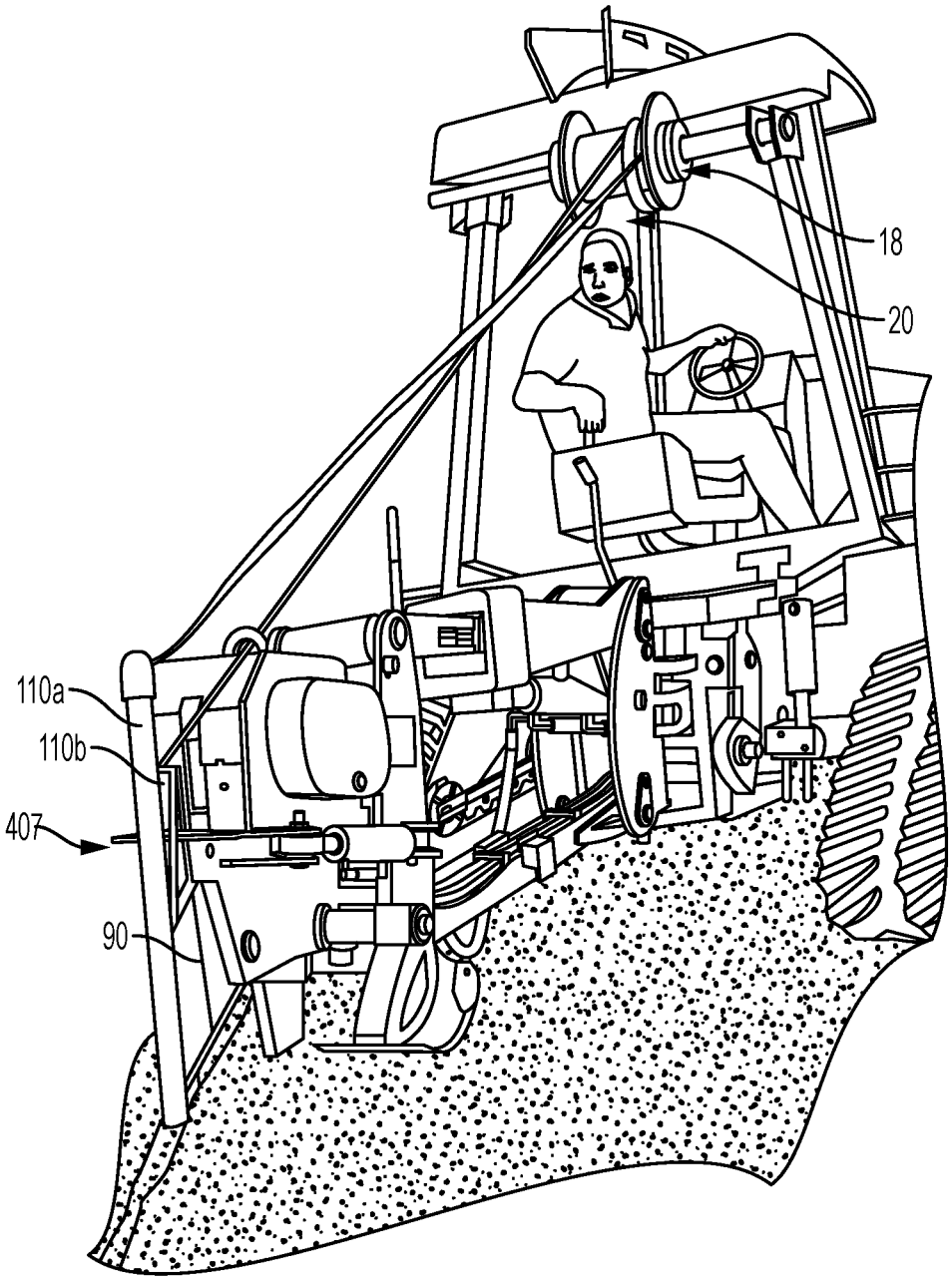
FIGS. 4A-4B are rear perspective views showing the use of an exemplary plow assembly as disclosed herein.

In further exemplary aspects, when the plow assembly 40 comprises at least one feed tube, the apparatus can further comprise at least one spool of wire and/or tape positioned in communication with the at least one feed tube. Optionally, in these aspects, when the at least one feed tube comprises a plurality of feed tubes 110*a*, 110*b*, the at least one spool of wire and/or tape can comprise a plurality of spools (e.g., spools 18, 20), and a first spool 18 can be different than at least one other spool of the plurality of spools. For example, it is contemplated that a first spool can provide a tracer wire to the first feed tube 110*a*, while a second spool can provide warning tape to the second feed tube 110*b*, thereby permitting simultaneous delivery of tracer wire and warning tape to a trench as the trench is formed. It is contemplated that wires, tape, and other like materials of any size can be used, provided the size is compatible with the dimensions of the displacement element 70. In exemplary aspects, the plurality of spools can be mounted or otherwise secured to the connecting structure 14 or a rear portion of the vehicle 11. Optionally, in these aspects, and as shown in FIGS. 4A-4B, the vehicle 11 can comprise a support bar to which the plurality of spools are coupled (e.g., mounted).

Optionally, in further exemplary aspects, the apparatus 10 can comprise a wheel assembly (not shown) coupled to the plow assembly and extending rearwardly relative to the transverse axis. Optionally, the wheel assembly can comprise a plurality of wheels, with at least one wheel being configured for positioning on opposing sides of the trench. In use, the wheels on opposing sides of the trench can be advanced over the displaced soil on the opposing sides of the trench to ensure that the displaced soil is returned to a desired position.

Figure 3A:
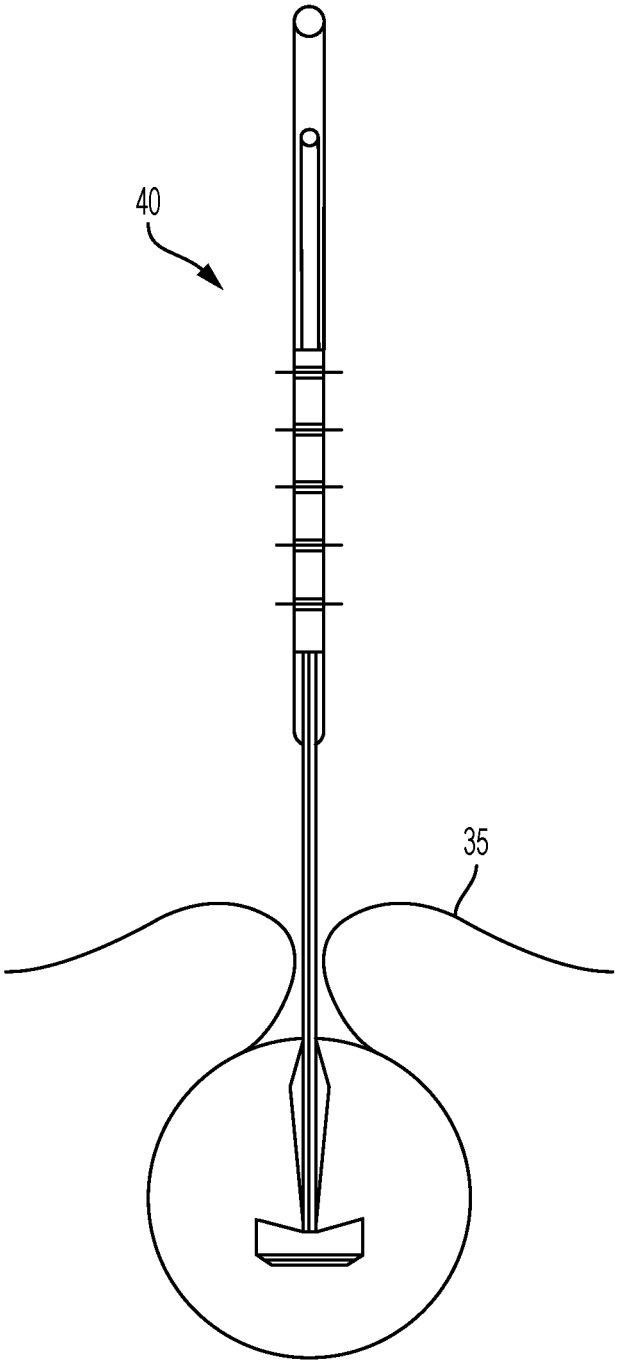
FIG. 3A is a rear elevational view showing the displacement of soil by an exemplary plow assembly as disclosed herein.
Figure 3B:
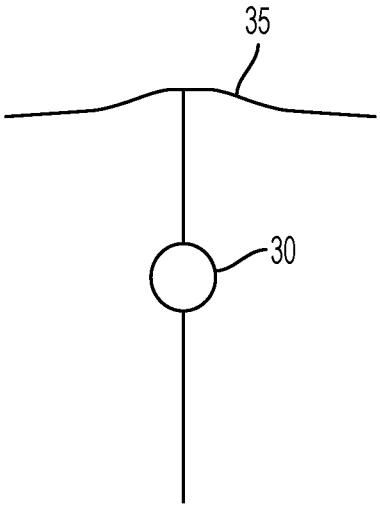
FIG. 3B is a rear elevational view showing the condition of the displaced soil following passage of the plow assembly.
Figure 4B:
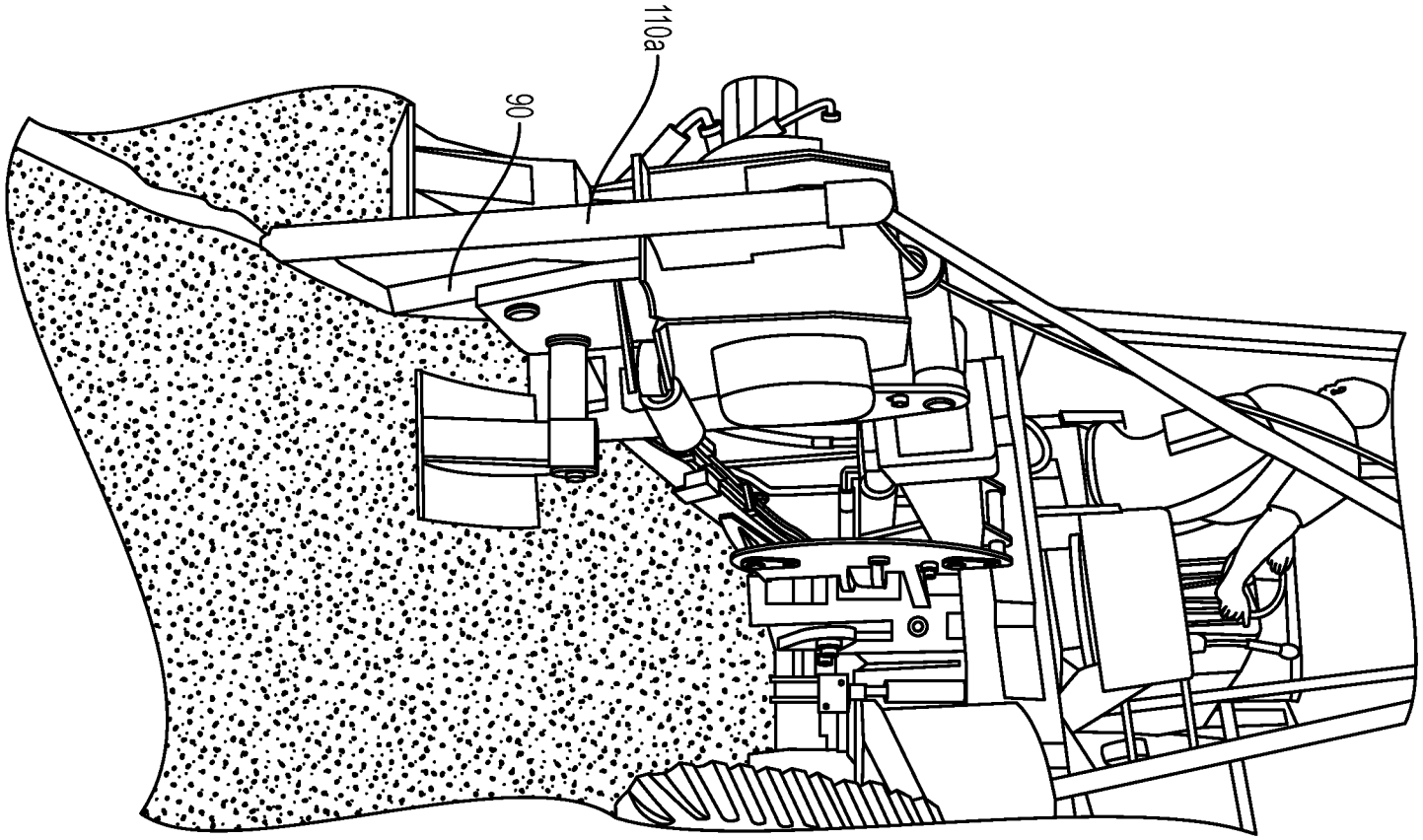

In use, and with reference to FIGS. 3A-4B, it is contemplated that the disclosed plow assembly can greatly reduce the amount of repair (e.g., excavation) needed to return the land surrounding a trench to a desired condition and appearance. FIG. 3A depicts the displacement of soil as the plow assembly is advanced through the selected land area. As shown, the tapered shape (optionally, rounded shape) of the displacement element can be configured to displace soil in a controlled and consistent manner, with generally symmetrical, raised (e.g., rounded) accumulations of soil being positioned on each side of the trench. Concurrently, the plow assembly pulls the pipe 30 into the trench as the trench as formed. Additionally, as further described herein, feed tubes 110*a*, 110*b* can deliver wire and/or tape into the trench. With reference to FIG. 2A, it can be appreciated that the cutting edge of the blade element, the outlets of the feed tubes, and the second (larger) end of the displacement element sequentially pass (in order) a given location along the length of the trench as the plow assembly passes through the soil. Due to the large size of the second end of the displacement element relative to the blade element and the pipe, the displacement element can displace soil upwardly on each side of the trench to create sufficient space for advancement of the pipe. As the second end of the displacement element passes a given location along the length of the trench, the accumulations of soil on each side of the trench can collapse inwardly to fill in the portions of the trench that are not occupied by the pipe and/or the wires and/or tape. After the soil collapses inwardly, only a small slit within the soil remains visible, and the collapsing soil surrounds the pipe pulled by the plow assembly and the wires and/or tape delivered by the feed tubes. Depending upon the size of the remaining slit, it is contemplated that there may be no need for any excavation or repair of the soil surrounding the trench. However, if there remains some discontinuity or an undesired appearance at the ground level, it is contemplated that a wheel assembly as disclosed herein, a vehicle, or other equipment can roll over the soil surrounding the trench to produce the desired soil appearance. Optionally, in exemplary aspects as further disclosed herein, a wheel assembly can be coupled to the plow assembly and follow behind the plow assembly as the plow assembly is advanced within the selected land area. An exemplary pipe installation procedure is depicted in FIGS. 4A-4B. As shown, the slit that remains following passage of the plow assembly is difficult to identify, and minimal or no further excavation is necessary.

In one exemplary aspect, the pipe can be provided as a coiled/spooled HDPE pipe. Optionally, in these aspects, it is contemplated that the pipe can be stretched out on the ground (space permitting). Alternatively, in other aspects, when the pipe is to be installed in a more congested space, the pipe can be provided on a horizontal style carousel type trailer or a vertical reel trailer that stores the pipe while it is being pulled into the ground by the plow assembly.

In still further exemplary aspects, a method of installing a pipe as disclosed herein can comprise securing a plow assembly to a vehicle, such as, for example and without limitation, a tractor. In these aspects, the method can further comprise coupling (e.g., attaching) the pipe to the displacement element of the plow assembly. The method can further comprise driving the vehicle over a selected land area to advance the plow assembly through soil of the selected land area. As the plow assembly is advanced within the soil of the selected land area, the cutting edge of the blade element cuts through the soil of the selected land area and the displacement element displaces the soil of the selected land area to form a trench. Concurrently, the displacement element pulls the pipe into the trench as the trench is formed. When the plow assembly comprises at least one feed tube, the method can further comprise delivering at least one wire and/or tape into the trench through the at least one feed tube. In exemplary aspects, the method does not comprise restoring the portions of the selected land area surrounding the trench. Alternatively, when the plow assembly comprises a wheel assembly as disclosed herein, the method can further comprise advancing the wheel assembly over the displaced soil on opposing sides of the trench to ensure that the displaced soil is returned to a desired position.

In exemplary aspects, when existing underground utilities are encountered during the installation of the pipe, the existing utility can be excavated and exposed, and the apparatus (including the plow assembly) can then be advanced while straddling the excavation. Next, the pipe can be advanced to the crossing utility, the chain (tether) can be disconnected from the pipe, the plow assembly can be raised (for example, using a connecting structure as is known in the art), the apparatus (including the plow assembly) can be advanced onto the opposite side of the crossing utility, the chain (tether) can be reconnected to the pipe, and pulling of the pipe can resume. As further disclosed herein, the length of the pipe to be pulled can range from 500 feet to about 2,000 feet per coil/reel. In exemplary aspects, the pipe can comprise six-inch HDPE pipe that is provided at a length ranging from about 1,000 feet to about 2,000 feet. Optionally, in these aspects, the pipe can be provided as a plurality of coils (e.g., three or more coils) that have been fused together or otherwise attached. In more congested areas, when trailers or other reel/spool systems are employed, a single coil of pipe can be pulled into the ground at a time, and the trailer or other reel/spool system can be re-loaded with another coil after the first coil is installed within the ground. The first coil can fused to the second coil end-to-end to ensure continuity in the coils. Once the desired length of pipe has been installed, the plow assembly can be gradually raised to pull a proximal portion of the pipe (closest to the plow assembly) out of the ground. The apparatus (including the plow apparatus) can then be used to pull another coil/spool of pipe at another location. In exemplary aspects, it is contemplated that the only excavation that is required during the installation process can occur at the beginning and the end of new coils/spools of pipe. In these aspects, it is contemplated that several feet of soil can be excavated in each direction at the starting point and end point of a coil/spool to thereby create free play in the rigid pipe (e.g., HDPE pipe) and permit fusing together of multiple coils/spools of pipe.

Although several embodiments of the invention have been disclosed in the foregoing specification, it is understood by those skilled in the art that many modifications and other embodiments of the invention will come to mind to which the invention pertains, having the benefit of the teaching presented in the foregoing description and associated drawings. It is thus understood that the invention is not limited to the specific embodiments disclosed hereinabove, and that many modifications and other embodiments are intended to be comprised within the scope of the appended claims. Moreover, although specific terms are employed herein, as well as in the claims which follow, they are used only in a generic and descriptive sense, and not for the purposes of limiting the described invention, nor the claims which follow.

What is claimed is:

1. A plow assembly for forming a trench within soil of a selected land area, the plow assembly comprising:

a blade element having a longitudinal axis and a cutting edge that extends along at least a portion of the blade element relative to the longitudinal axis, wherein the blade element has opposed proximal and distal ends and a rear edge that is opposed from the cutting edge;

a displacement element having opposed first and second ends, wherein the first end of the displacement element is secured to the distal end of the blade element, wherein the second end of the displacement element is spaced from the rear edge of the blade element relative to a transverse axis that is perpendicular to the longitudinal axis of the blade element, wherein the second end of the displacement element is configured for coupling to a pipe to be positioned within the trench;

an attachment element secured to the proximal end of the blade element, wherein the attachment element is configured to permit selective attachment of the plow assembly to a vehicle; and a traction bar secured to the first end of the displacement element, wherein the traction bar extends outwardly from the first end of the displacement element relative to the transverse axis, and wherein the traction bar is shaped to apply a downward pulling force to the displacement element as the plow assembly is advanced within soil of the selected land area, wherein, as the plow assembly is advanced within the soil of the selected land area, the cutting edge of the blade element is configured to cut through the soil of the selected land area and the displacement element is configured to displace the soil of the selected land area to form the trench and to pull the pipe into the trench as the trench is formed.

2. The plow assembly of claim 1 wherein the displacement element has a consistent outward taper moving from the first end of the displacement element to the second end of the displacement element, and wherein the displacement element is consistently outwardly tapered at a taper angle ranging from about 5 degrees to about 30 degrees.

3. The plow assembly of claim 2, wherein the first end of the displacement element has a diameter ranging from about 0.10 inches to about 2 inches, and wherein the second end of the displacement element has a diameter ranging from about 8 inches to about 16 inches.

4. The plow assembly of claim 1 wherein the second end of the displacement element is positioned at an acute angle ranging from about 5 degrees to about 20 degrees relative to the transverse axis.

5. The plow assembly of claim 1 wherein the displacement element has a central axis that is positioned at an acute angle ranging from about 5 degrees to about 20 degrees relative to the transverse axis.

6. The plow assembly of claim 1 wherein the blade element comprises a wear plate extending from the cutting edge in a rearward direction relative to the transverse axis.

7. The plow assembly of claim 1 wherein the attachment element defines a plurality of axially spaced holes that are configured for alignment with corresponding holes of a connecting structure of a vehicle.

8. The plow assembly of claim 1, further comprising at least one feed tube coupled to one or more of the attachment element and the blade element, wherein each feed tube of the at least one feed tube has an outlet positioned rearwardly of the blade element relative to the transverse axis, and wherein the at least one feed tube is configured to deliver wire or tape to the trench formed by the blade element and the displacement element.

9. The plow assembly of claim 8, wherein the at least one feed tube comprises a plurality of feed tubes, and wherein the plurality of feed tubes comprises a first feed tube having an inner diameter that is different than an inner diameter of at least one other feed tube of the plurality of feed tubes.

10. The plow assembly of claim 1 wherein the displacement element is selectively detachable from the blade element.

11. The plow assembly of claim 1 wherein the second end of the displacement element defines a pulling eye that is configured to receive a portion of a chain for coupling the pipe to the displacement element.

12. An apparatus comprising:

a vehicle having an attachment arm; and a plow assembly configured to form a trench within soil of a selected land area, the plow assembly comprising:

a blade element having a longitudinal axis and a cutting edge that extends along at least a portion of the blade element relative to the longitudinal axis, wherein the blade element has opposed proximal and distal ends and a rear edge that is opposed from the cutting edge;

a displacement element having opposed first and second ends, wherein the first end of the displacement element is secured to the distal end of the blade element, wherein the second end of the displacement element is spaced from the rear edge of the blade element relative to a transverse axis that is perpendicular to the longitudinal axis of the blade element, wherein the second end of the displacement element is configured for coupling to a pipe to be positioned within the trench;

an attachment element secured to the proximal end of the blade element; and a traction bar secured to the first end of the displacement element, wherein the traction bar extends outwardly from the first end of the displacement element relative to the transverse axis, and wherein the traction bar is shaped to apply a downward pulling force to the displacement element as the plow assembly is advanced within soil of the selected land area, wherein the attachment element of the plow assembly is secured to the attachment arm of the vehicle, and wherein, as the plow assembly is advanced within the soil of the selected land area, the cutting edge of the blade element is configured to cut through the soil of the selected land area and the displacement element is configured to displace the soil of the selected land area to form the trench and to pull the pipe into the trench as the trench is formed.

13. The apparatus of claim 12, wherein the vehicle is a vibratory plow tractor.

14. The apparatus of claim 12, wherein the plow assembly comprises at least one feed tube, and wherein the apparatus further comprises at least one spool of wire or tape positioned in communication with the at least one feed tube.

15. The apparatus of claim 12, further comprising a wheel assembly coupled to the plow assembly and extending rearwardly relative to the transverse axis, wherein, as the plow assembly is advanced within the soil of the selected land area, the wheel assembly is advanced over the displaced soil on opposing sides of the trench.

16. A method comprising:

securing a plow assembly to a vehicle having an attachment arm, the plow assembly comprising:

a blade element having a longitudinal axis and a cutting edge that extends along at least a portion of the blade element relative to the longitudinal axis, wherein the blade element has opposed proximal and distal ends and a rear edge that is opposed from the cutting edge;

a displacement element having opposed first and second ends, wherein the first end of the displacement element is secured to the distal end of the blade element, wherein the second end of the displacement element is spaced from the rear edge of the blade element relative to a transverse axis that is perpendicular to the longitudinal axis of the blade element, wherein the second end of the displacement element is configured for coupling to a pipe to be positioned within the trench;

an attachment element secured to the proximal end of the blade element, wherein the attachment element is configured to permit selective attachment of the plow assembly to a vehicle; and a traction bar secured to the first end of the displacement element, wherein the traction bar extends outwardly from the first end of the displacement element relative to the transverse axis, and wherein the traction bar is shaped to apply a downward pulling force to the displacement element as the plow assembly is advanced within soil of the selected land area, wherein the attachment element of the plow assembly is secured to the attachment arm of the vehicle;

securing a pipe to the displacement element of the plow assembly;

driving the vehicle over a selected land area to advance the plow assembly through soil of the selected land area, wherein, as the plow assembly is advanced within the soil of the selected land area, the cutting edge of the blade element cuts through the soil of the selected land area and the displacement element displaces the soil of the selected land area to form a trench and pulls the pipe into the trench as the trench is formed.

17. The method of claim 16, wherein the plow assembly comprises at least one feed tube, and wherein the method further comprises delivering at least one wire or tape into the trench through the at least one feed tube.

18. The method of claim 16, wherein the method does not comprise restoring the portions of the selected land area surrounding the trench.

19. The method of claim 16, wherein the plow assembly comprises a wheel assembly coupled to the plow assembly and extending rearwardly relative to the transverse axis, and wherein the method further comprises advancing the wheel assembly over the displaced soil on opposing sides of the trench.

* * * * *